US008470132B2

(12) United States Patent
Jiang et al.

(10) Patent No.: US 8,470,132 B2
(45) Date of Patent: Jun. 25, 2013

(54) NEAR NEUTRAL CHLORINE DIOXIDE BLEACHING OF PULP

(75) Inventors: Zhi-Hua Jiang, Kirkland (CA); Richard McKinnon Berry, Notre-Dame-de-l'Ile Perrot (CA)

(73) Assignee: FPInnovations, Pointe-Claire, Quebec (CA)

( * ) Notice: Subject to any disclaimer, the term of this patent is extended or adjusted under 35 U.S.C. 154(b) by 461 days.

(21) Appl. No.: 12/224,794

(22) PCT Filed: Feb. 12, 2007

(86) PCT No.: PCT/CA2007/000198

§ 371 (c)(1),
(2), (4) Date: Sep. 5, 2008

(87) PCT Pub. No.: WO2007/104128

PCT Pub. Date: Sep. 20, 2007

(65) Prior Publication Data

US 2009/0101296 A1 Apr. 23, 2009

Related U.S. Application Data

(60) Provisional application No. 60/781,385, filed on Mar. 13, 2006.

(51) Int. Cl.
*D21C 9/14* (2006.01)

(52) U.S. Cl.
USPC ..... 162/87; 162/89

(58) Field of Classification Search
USPC ..... 162/89, 90
See application file for complete search history.

(56) References Cited

U.S. PATENT DOCUMENTS

| | | | | |
|---|---|---|---|---|
| 3,944,463 | A | 3/1976 | Samuelson et al. | |
| 4,035,470 | A | 7/1977 | Senjo et al. | |
| 5,759,349 | A * | 6/1998 | Foster et al. | 162/158 |
| 6,302,999 | B1 | 10/2001 | Engelhardt et al. | |
| 6,464,832 | B2 | 10/2002 | Engelhardt et al. | |
| 6,991,705 | B2 | 1/2006 | Leino et al. | |
| 2003/0150570 | A1 * | 8/2003 | Leino et al. | 162/9 |
| 2003/0155086 | A1 | 8/2003 | Sjoblom et al. | |
| 2003/0168190 | A1 | 9/2003 | Jokinen et al. | |
| 2004/0050511 | A1 | 3/2004 | Lambert | |
| 2004/0238455 | A1 | 12/2004 | Leino | |
| 2006/0185808 | A1 * | 8/2006 | Nguyen | 162/162 |

FOREIGN PATENT DOCUMENTS

| | | |
|---|---|---|
| CA | 756967 | 4/1967 |
| EP | 0 899 373 | 3/1999 |
| GB | 815247 | 6/1959 |

OTHER PUBLICATIONS

"Fluorescent Whitening Agents", Kirk-Othmer, 4th Ed., vol. 11, pp. 227 to 241, 2001.

* cited by examiner

*Primary Examiner* — Anthony Calandra
(74) *Attorney, Agent, or Firm* — Norton Rose Canada LLP

(57) ABSTRACT

Final chlorine dioxide bleaching of lignocellulosic materials is most effective at a near-neutral pH but present industrial practice typically targets a final pH of between 3.5 and 4.0 because of the difficulty in achieving and maintaining near-neutral pH cost effectively. The in situ formation of bicarbonate before the addition of chlorine dioxide provides a way of maintaining the required near-neutral pH. Near-neutral final chlorine dioxide bleaching also produces a bleached pulp that is in a state that responds more effectively to fluorescent whitening or optical brightening agents.

20 Claims, No Drawings

NEAR NEUTRAL CHLORINE DIOXIDE BLEACHING OF PULP

CROSS-REFERENCE TO RELATED APPLICATIONS

This application is a National entry of PCT/CA2007/000198 filed Feb. 12, 2007, in which the United States of America was designated and elected, and which remains pending in the International phase until Sep. 13, 2008, which application in turn claims priority from U.S. Provisional application Ser. No. 60/781,385 filed Mar. 13, 2006.

The application claims priority under 35 U.S.C. 119(e) from U.S. Provisional application Ser. No. 60/781,385 filed Mar. 13, 2006.

TECHNICAL FIELD

This invention relates to a method for bleaching a lignocellulosic material, and more particularly, to a method for improving the performance of chlorine dioxide in the process of bleaching lignocellulosic pulp.

BACKGROUND ART

The removal of lignin in lignocellulosic materials such as chemical pulp is accomplished by a multi-stage application of bleaching chemicals. Chlorine dioxide is the chemical of choice because it reacts readily and selectively with lignin and does not react to any significant extent with carbohydrate. A typical bleaching sequence uses a chlorine dioxide delignification stage (notated as $D_0$), an alkaline extraction stage in which oxygen gas and peroxide are commonly added (notated as Eop), and a final brightening procedure which can comprise one chlorine dioxide stage (notated as D) or two chlorine dioxide stages (notated as $D_1$ and $D_2$, respectively) with or without an intermediate extraction stage.

A final chlorine dioxide bleaching stage, such as D or $D_2$, is typically run at a temperature between 55 to 85° C. with a retention time between 2 and 4 hours and a consistency between 8 and 15%. The pH is typically adjusted with sodium hydroxide or sulphuric acid before the chlorine dioxide to provide a final pH of between 3.5 and 4.0.

Prior art shows that the maximum brightness development is achieved by keeping the pH during the final brightening stage very close to neutral (5.0 to 7.0). It has been demonstrated in the laboratory that, by using soluble buffers such as potassium dihydrogen phosphate, maximum brightness is achieved at a pH between 5.0 and 6.5 [1]. Canadian Patent No. 756,967 discloses a process for neutral chlorine dioxide bleaching wherein neutral conditions are maintained by the addition of carbonates, oxides of alkaline earth materials, or bicarbonates of alkali or alkaline earth metals which are of sufficiently limited solubility [2]. Neither of these processes are practised commercially. The soluble buffers such as potassium dihydrogen phosphate are too expensive for industrial application while the handling of sparingly soluble buffers such as sodium bicarbonate is difficult. For these reasons present industrial practice is to adjust pH at the beginning of the stage with either a soluble alkali or acid to provide a final pH of between 3.5 and 4.0, which has been reported as the optimal end pH under unbuffered conditions [3,4].

DISCLOSURE OF THE INVENTION

It is an object of this invention to provide an improved process for delignification of a lignocellulosic pulp.

It is a further object of this invention to provide a process for delignification of a lignocellulosic pulp.

It is a specific object of the present invention to provide an improvement to a final chlorine dioxide bleaching stage such as D or $D_2$, in the delignification of a lignocellulosic pulp, by increasing the brightness before and/or after the application of fluorescent whitening agent (FWA) or optical brightening agent (OPA) with the same charge of chlorine dioxide and FWA or OPA.

It is another specific object of this invention to provide an improvement to a final chlorine dioxide bleaching stage such as D or $D_2$, in the delignification of a lignocellulosic pulp, by maintaining the brightness before and/or after the application of fluorescent whitening agent (FWA) or optical brightening agent (OPA) with a smaller chlorine dioxide charge in the final stage or in previous stages and/or a smaller charge of FWA or OPA.

In one aspect of the invention, there is provided in a process for delignification of a lignocellulosic pulp in an aqueous suspension in which delignification is carried out with chlorine dioxide at least in a final bleaching stage, the improvement wherein said final bleaching stage is carried out at a pH buffered in a neutral region, the buffered pH being established by in situ generation of bicarbonate in said pulp suspension from an alkaline agent and carbon dioxide in the suspension.

In another aspect of the invention, there is provided a process for delignification of a lignocellulosic pulp in an aqueous suspension comprising the steps of:

a) bleaching the pulp in said suspension, in which a final bleaching is carried out with chlorine dioxide at a buffered pH in a neutral region, wherein the buffered pH is established by in situ generation of bicarbonate in said pulp suspension, from an alkaline agent and carbon dioxide in the suspension, and b) brightening the bleached pulp from step a) with a fluorescent whitening agent or an optical brightening agent.

DETAILED DESCRIPTION OF THE INVENTION

The process of the invention enhances the effectiveness of chlorine dioxide bleaching of lignocellulosic material and is a process in which the final chlorine dioxide bleaching stage is maintained under a near-neutral pH by the in-situ formation of a sparingly soluble buffer by applying an alkaline agent and carbon dioxide.

The invention relates to the in-situ formation of a sparingly soluble buffer and the adjustment of the pH to near-neutral. The buffer can be formed by the application of an alkaline solution followed by the application of carbon dioxide which, in contact with the alkaline solution, forms a bicarbonate buffer and brings the pH to near neutral; or the application, to an already alkaline pulp, of carbon dioxide which, in contact with the alkaline pulp, forms a bicarbonate buffer and brings the pH to near neutral.

In the present invention, the near-neutral pH condition is maintained by the addition of carbon dioxide to an alkaline slurry of the pulp to be bleached in a final chlorine dioxide stage. Under some industrial operating conditions the pulp slurry may already be in an alkaline form, for example, after an alkaline extraction stage. Under other conditions the pulp may need to be first adjusted to an alkaline pH. The amount of alkalinity present in the pulp must be adequate to produce enough bicarbonate when carbon dioxide is added, to maintain the near-neutral pH during the addition of the acidic chlorine dioxide and the acid-generating bleaching stage. Alkali addition points can be the washer showers, the washer repulper, the steam mixer and the chemical mixer. Carbon dioxide addition points can be the steam and chemical mixers.

The preferred method of addition is injection of carbon dioxide gas into the pulp slurry. The carbon dioxide may, however, also be added in liquid or solid form. The initial pH, after carbon dioxide addition and before chlorine dioxide addition, is generally in the range between 7 and 10 and the final pH is suitably 4.5 to 7 and preferably in the range between 5 and 6.

The lignocellulosic materials used in the method of the present invention can be a wood and/or non-wood derived lignocellulosic material and can be introduced as chips, wafers, slivers, or pulps which are treated with other known bleaching agents before being subjected to the final chlorine dioxide bleaching. For example, typical bleaching stages applied to a pulp before a final chlorine dioxide bleaching stage can be another chlorine dioxide stage, an extraction, oxygen delignification, ozone, peroxide, peracetic acid, chelation, acid hydrolysis, or enzyme treatment, applied as a single stage or as multi-stages, with or without washing between the stages.

Typically the delignification process is a multi-stage bleaching, and the carbon dioxide is added to the pulp suspension immediately prior to the final chlorine dioxide bleaching stage.

Typically the multi-stage bleaching has a sequence selected from:

$D_0 E_x D$, $D_0 E_x D_1 D_2$, $D_o E_x D_1 n D_2$ and $D_0 E_x D_1 E D_2$, in which $E_x$ is E, $E_0$, $E_p$ or $E_{op}$ where n indicates addition of alkali at the end of the $D_1$ stage.

The alkaline agent which reacts with carbon dioxide to generate bicarbonate in situ in the pulp suspension is suitably a hydroxide of an alkali metal or an alkaline earth metal. Suitable hydroxides include lithium hydroxide, sodium hydroxide, potassium hydroxide, barium hydroxide, calcium hydroxide and magnesium hydroxide.

The fluorescent whitening agent or optical brightening agent added to the pulp recovered from the process of the invention may be added directly to the pulp or to a paper formed from the pulp. A full description of these types of agent is given in Reference 5, the teachings of which are incorporated herein by reference, but typically the agents used in pulp and paper applications are based on stilbene-triazine or biphenyl structures. Suitable agents are bistriazinyl derivatives of 4,4'-diaminostilbene-2,2'-disulfonic acid; 2-(stilbene-4-yl)naphthotriazoles; 2-(4-phenylstilbene-4-yl) benzoazoles; bis(azol-2-yl)stilbenes; bis(styryl)benzenes, bis(styryl)biphenyls; bis(benzimidazol-2-yl)s; 2-(benzofuran-2-yl)benzimidazoles; coumarins, carbostyrils; and alkoxy-naphthalimides.

The process of the invention improves the brightness of the pulp and also provides an improvement in the response of the bleached pulp to subsequently applied fluorescent whitening agent or optical brightening agent.

Thus, in one advantageous embodiment, the bleaching in step a) is carried out with a reduced charge of chlorine dioxide while achieving a brightness in the pulp recovered from step b) comparable to that when the delignification is carried out with a full charge of chlorine dioxide, in the absence of the in situ generation of the bicarbonate.

In another advantageous embodiment, the brightening in step b) is carried out with a reduced charge of the whitening agent or brightening agent, while achieving a brightness in the pulp recovered from step b) comparable to that when the delignification is carried out with a full charge of the whitening agent or brightening agent.

In still another advantageous embodiment, the process of the invention includes a step of recovering a pulp from step b) having a brightness higher than that for a comparable process in the absence of the in situ generation of the bicarbonate.

The chlorine dioxide solution used in the method of the present invention can be generated using known processes and may or may not contain chlorine or other chlorine species. The lignocellulosic material is placed in a vessel or container, to which is added a solution containing chlorine dioxide. The bleaching reaction is conducted at a temperature within the range from about 40° C. to about 95° C., at a consistency from 2 to 20%. The amount of chlorine dioxide added to the stage, based on oven-dry lignocellulosic material, can range from 0.5 to 20 kg/ton.

In a preferred embodiment of the invention, the conditions in the final chlorine dioxide stage are a temperature of 70° C., a consistency of 10%, and a chlorine dioxide charge of between 1 and 2 kg/ton based on oven-dry lignocellulosic material.

In this specification, a pH in a neutral region is understood to be one close to or at neutral pH, more especially 4.5 to 7 and preferably 5 to 6.

EXAMPLES

In order to disclose more clearly the nature of the present invention, the following examples illustrate the invention.

Example 1

A hardwood kraft pulp oxygen-delignified and partially bleached in a mill with a $D_0$Eop sequence was thoroughly washed in the laboratory and bleached with a final chlorine dioxide stage. $D_0$ represents a chlorine dioxide delignification stage, while Eop represents an alkaline extraction stage fortified with oxygen and peroxide. The kappa number of the $D_0$Eop pulp was 2.0.

The final chlorine dioxide bleaching stage (D) was carried out by placing the pulp in a vessel, and mixing appropriately heated water into the pulp and adjusting the pH to a predetermined value using sodium hydroxide (NaOH) or carbon dioxide if required, followed immediately by a rapid addition of chlorine dioxide solution. The charge of chlorine dioxide added to the pulp slurry was set at 1.70 kg per ton of oven-dry pulp. The pulp consistency was 12.0%, the reaction temperature was 70° C., and the reaction time was 97 minutes. After the reaction, the pulp was thoroughly washed.

TABLE 1

| | Experiment number | | | |
|---|---|---|---|---|
| | 1 | 2 | 3 | 4 |
| NaOH added kg/ton on o.d. pulp basis | — | 0.5 | 0.14 | 0.28 |
| $CO_2$ added kg/ton on o.d. pulp basis | — | — | 0.14 | 0.28 |
| $H_2SO_4$ added kg/ton on o.d. pulp basis | 2.5 | — | — | — |
| pH just before $ClO_2$ addition | 3.5 | 11.1 | 7.9 | 9.4 |
| Final pH | 3.4 | 6.0 | 5.3 | 6.0 |
| ISO brightness, % | 91.4 | 91.6 | 91.9 | 91.9 |

It is readily evident from the results in Table I, that there is a brightness advantage over conventional operation (Experiment 1) that is obtained by using the application of an alkali and carbon dioxide (Experiments 3 and 4) to buffer the final brightening stage. It is also evident from Table I that achieving a final pH in the targeted range without buffering (Experiment 2) does not give the brightness increase that is possible from the process described in this application. The enhanced effectiveness of chlorine dioxide bleaching through achieving and maintaining a near-neutral pH is shown by the higher ISO brightness obtained (91.9%, Experiment Number 3 and 4) than that obtained in the control experiment (91.4%, Experiment Number 1).

Example 2

An oxygen-delignified hardwood kraft pulp with a kappa number 7.6 was bleached using a $D_0$EopD sequence.

The $D_0$ and D stages used the procedures employed in Example 1 but the charges of chlorine dioxide in the $D_0$ stage was decreased substantially when near-neutral conditions were used. The charges of chlorine dioxide in the $D_0$EopD sequence were as follows: 0.62% or 0.85% in the $D_0$ stage for near-neutral or conventional bleaching respectively and 0.17% in the D stage. Other reaction conditions for the $D_0$ stage were: consistency 10%, reaction time 54 minutes, reaction temperature 60° C. Other reaction conditions for the D stage were: consistency 12%, reaction time 97 minutes, reaction temperature 70° C. The D stage was carried out with and without adding using carbon dioxide.

The extraction stage (Eop) was carried out at 10% consistency in a laboratory pressurized peg mixer maintained at 0.14 MPa oxygen pressure for the first 10 minutes of the reaction, and at atmospheric pressure for 50 minutes. The reaction temperature was maintained at 75° C. and the charge of NaOH and peroxide was 0.64% and 0.33% based on the weight of oven-dried pulp, respectively.

The pulp was thoroughly washed after each bleaching stage.

Handsheet samples of the $D_0$EopD bleached pulps were also prepared for evaluating their responses toward fluorescent whitening agents (FWA) or optical brightening agents (OPA). A volume of Tinopah HW solution (0.5% of deionised water) was applied to the handsheet sample with a syringe and the sample was then dried and brightness measured.

It is readily evident from an examination of the results in Table II, that compared to the conventional D stage (Experiment 6), the present invention of maintaining a near-neutral pH in the D stage by using carbon dioxide and a base (Experiment 5) still gives a higher final brightness (91.7 versus 91.4) even when the amount of chlorine dioxide used in the $D_0$ stage has been decreased by 27%. It is also readily evident from the data in the last 2 rows of Table II that it also provides an improvement to the response of the final bleached pulps toward the application of a fluorescent whitening agent.

TABLE II

| | Experiment number ($D_0$EopD sequence) | |
|---|---|---|
| | 5 | 6 |
| Chlorine dioxide added in $D_0$ kg/ton on o.d. pulp basis | 6.2 | 8.5 |
| Kappa number after $D_0$Eop | 3.0 | 2.2 |
| Chlorine dioxide added in D kg/ton on o.d. pulp basis | 1.7 | 1.7 |
| $H_2SO_4$ added in D kg/ton on o.d. pulp basis | — | 0.5 |

TABLE II-continued

| | Experiment number ($D_0$EopD sequence) | |
|---|---|---|
| | 5 | 6 |
| NaOH added in D kg/ton on o.d. pulp basis | 0.28 | — |
| $CO_2$ added in D kg/ton on o.d. pulp basis | 0.38 | — |
| Final pH in D | 5.5 | 3.2 |
| ISO brightness after $D_0$EopD, % | 91.7 | 91.4 |
| Unit of brightness gain (ISO, %) after FWA application with a charge of Tinopal HW of 0.2% w/w (based on o.d.) | 5.6 | 4.2 |
| Unit of brightness gain (ISO, %) after FWA application with a charge of Tinopal HW of 1.0% w/w (based on o.d.) | 6.6 | 5.9 |

REFERENCES

1. Rapson, W. H., *Tappi J,* 39(5):284, 1956.
2. Sepall, O., Canadian Patent No. 756, 967, 1967.
3. Rapson, W. H. and Anderson, C. B., *CPPA Trans. Tech Sect,* 3(2):TR52, 1977.
4. Reeve, D. W., in *Pulp Bleaching—Principle and Practice*, (C. W. Dence and D. W. Reeve, Eds.), TAPPI Press, Atlanta, 1996, pp. 379-394.
5. Kirk-Othmer 4$^{th}$ Edition, "Fluorescent Whitening Agents". Vol. 11, p. 227.

The invention claimed is:

1. In a process for delignification of a lignocellulosic pulp in an aqueous suspension in which delignification is carried out with chlorine dioxide at least in a final bleaching stage, the improvement wherein said final bleaching stage is carried out at a buffered pH of 4.5 to 7, the buffered pH being established by in situ generation of bicarbonate in said pulp suspension from an alkaline agent and carbon dioxide in the suspension; wherein the penultimate stage is an alkaline stage or a neutralization (n) stage.

2. The process of claim 1, wherein said delignification is carried out with a multi-stage bleaching, and the carbon dioxide is added to the pulp suspension immediately prior to the final chlorine dioxide bleaching stage.

3. The process of claim 2, wherein the multi-stage bleaching has a sequence selected from:

$D_0\ E_x\ D$, $D_0\ E_x\ D_1 n D_2$ and $D_0\ E_x\ D_1\ E\ D_2$, in which $E_x$ is E, $E_0$, $E_p$ or $E_{op}$ and n is the addition of alkali at the end of the $D_1$ stage.

4. The process of claim 1, wherein the alkaline agent and the carbon dioxide are added to the pulp suspension immediately prior to the final chlorine dioxide bleaching stage.

5. The process of claim 1, wherein said alkaline agent is selected from hydroxides of alkali metals and alkaline earth metals.

6. A process for delignification of a lignocellulosic pulp in an aqueous suspension comprising the steps of:

a) bleaching the pulp in said suspension, in which a final bleaching is carried out with chlorine dioxide at a buffered pH of 4.5 to 7, wherein the buffered pH is established by in situ generation of bicarbonate in said pulp suspension, from an alkaline agent and carbon dioxide in the suspension; wherein the penultimate stage is an alkaline stage or a neutralization (n) stage, and b) brightening the bleached pulp from step a) with a fluorescent whitening agent or a brightening agent.

7. A process according to claim 6, wherein said brightening in step b) is with a fluorescent whitening agent.

8. A process according to claim 6, wherein said brightening in step b) is with an optical brightening agent.

9. A process according to claim 6, wherein said bleaching in step a) is carried out with a reduced charge of chlorine dioxide while achieving a brightness in the pulp recovered from step b) comparable to that when the delignification is carried out with a full charge of chlorine dioxide, in the absence of the in situ generation of the bicarbonate, said reduced charge being less than said full charge.

10. A process according to claim 6, wherein said brightening in step b) is carried out with a reduced charge of the whitening agent or brightening agent, while achieving a brightness in the pulp recovered from step b) comparable to that when the delignification is carried out with a full charge of the whitening agent or brightening agent, said reduced charge being less than said full charge.

11. A process according to claim 6, including a step of recovering a pulp from step b) having a brightness higher than that for a comparable process in the absence of the in situ generation of the bicarbonate.

12. A process according to claim 6, wherein step a) comprises a multi-stage.

13. A process according to claim 12, wherein the multi-stage bleaching has a sequence selected from:

$D_0\ E_x\ D$, $D_0\ E_x\ D_1 n D_2$ and $D_0\ E_x\ D_1\ E\ D_2$, in which $E_x$ is E, $E_0$, $E_p$ or $E_{op}$, and n is the addition of alkali at the end of the $D_1$ stage.

14. A process according to claim 11, wherein the alkaline agent and the carbon dioxide are added to the pulp suspension immediately prior to the final chlorine dioxide bleaching stage.

15. A process according to claim 11, wherein said alkaline agent is selected from hydroxides of alkali metals and alkaline earth metals.

16. The process of claim 3, wherein the alkaline agent and the carbon dioxide are added to the pulp suspension immediately prior to the final chlorine dioxide bleaching stage.

17. The process of claim 16, wherein said alkaline agent is selected from hydroxides of alkali metals and alkaline earth metals.

18. A process according to claim 13, wherein the alkaline agent and the carbon dioxide are added to the pulp suspension immediately prior to the final chlorine dioxide bleaching stage.

19. A process according to claim 13, wherein said alkaline agent is selected from hydroxides of alkali metals and alkaline earth metals.

20. A process according to claim 14, wherein said alkaline agent is selected from hydroxides of alkali metals and alkaline earth metals.

* * * * *